US005879202A

United States Patent [19]

Zhao

[11] Patent Number: 5,879,202

[45] Date of Patent: Mar. 9, 1999

[54] BATTERY TERMINAL CONNECTOR

[75] Inventor: Weiping Zhao, Canton, Mich.

[73] Assignee: Aluminum Company of America, Pittsburgh, Pa.

[21] Appl. No.: 874,112

[22] Filed: Jun. 12, 1997

[51] Int. Cl.[6] ..... H01R 4/42

[52] U.S. Cl. ..... 439/762; 439/761

[58] Field of Search ..... 439/759–764, 439/765

[56] References Cited

U.S. PATENT DOCUMENTS

| | | | |
|---|---|---|---|
| 1,746,514 | 2/1930 | Baunach . | |
| 3,116,100 | 12/1963 | Hunter . | |
| 4,576,430 | 3/1986 | Dufresne . | |
| 5,088,941 | 2/1992 | Nolle | 439/762 |
| 5,290,646 | 3/1994 | Asao et al. | 439/762 |
| 5,454,741 | 10/1995 | Okada | 439/762 |
| 5,498,178 | 3/1996 | Tabata | 439/762 |
| 5,595,510 | 1/1997 | Obligar | 439/761 |

FOREIGN PATENT DOCUMENTS

| | | |
|---|---|---|
| 3811629 | 11/1988 | Germany . |
| 645738 | 9/1962 | Italy . |

*Primary Examiner*—Neil Abrams
*Attorney, Agent, or Firm*—Edward L. Levine

[57] ABSTRACT

A battery terminal connector for connection to a battery post, particularly useful in automotive application. The connector includes a plate having an aperture which is shaped and sized to fit about the battery post. A slot extends from the aperture to one end of the plate so as to form two spines in the plate which are separated by the slot. With the plate positioned in a horizontal orientation, one spine has an extender element, such as a bolt, extending upwardly from the spine. The other spine has a receiving element such as an upwardly extending clasp. A camming band seats about the bolt and about the clasp, and extends across the slot. A nut is rotatable on the bolt and can be moved downwardly to forcibly contact the camming band. The nut and camming band have cooperating surfaces such that downward movement of the nut on the bolt forces the camming band to move laterally relative to the bolt. This lateral motion of the camming band pulls the clasp so that the bolt and clasp move toward each other. Correspondingly, the two spines move toward each other, contracting the width of the slot between the spines. This contraction also tightens the aperture about the battery post.

38 Claims, 14 Drawing Sheets

BATTERY TERMINAL CONNECTOR

BACKGROUND OF THE INVENTION

1. Field of the Invention

This invention relates to battery terminal connectors of the type suitable for use with automotive batteries, and more particularly to a connector which can be installed from above by applying a lateral torque to actuate a firm grip about a vertical battery post.

2. Description of the Prior Art

Numerous types of terminal connectors are available to connect an electrical conduit to a battery in automotive type applications. Some, such as those including a laterally extending tightening bolt, are simple. Many, however, such as those with a vertical tightening bolt, are more complex to manufacture, require numerous parts and operations, and are more susceptible to failure. Additionally, many such connectors are relatively large and bulky. As automobiles have become more streamlined with added attention to aerodynamics, the space available for placement of a battery, under the hood or elsewhere in the automobile, has become limited. This is particularly a concern where original equipment manufacturers are offering world cars where it is desirable to standardize on common parts. There is a premium on automotive components that allow better space utilization and ease of installation. For example, many simple connectors attach a generally cylindrical clip about a vertical post extending upwardly from the battery. The clip is tightened into engagement with the post by a horizontally oriented bolt. Gaining access to the horizontal bolt is sometimes difficult. With improved design and attention to fabrication techniques, manufacture of terminal connectors can be made easier, resulting in a less expensive and more rapidly manufactured part.

To address the access concern, battery terminal connectors which engage a vertical battery post through application of a lateral torque about a vertically oriented bolt have been proposed. In this manner, the operator can work through direct access to the top of the battery. This is particularly beneficial in new car construction where a robotic tool may be involved in the initial installation. These types of connectors are herein referred to as "vertical access connectors".

One such vertical access connector is disclosed in U.S. Pat. No. 5,454,741. That connector includes a vertically oriented, generally cylindrical post fitting including two clamping members extending laterally from the fitting and forming a gap between the members. As the gap is closed, the fitting tightens about the battery post. To close the gap, a separate tightening tool, having a vertical bolt and camming surfaces conforming to the clamping members, is laterally slid onto the members and, upon applying a lateral torque to the bolt, the tool forces the members together. While allowing vertical access, the design relies on the camming action of the clamping members themselves. This results in a connector that is difficult to fabricate and, in order to provide sufficient gripping force, may require a taller fitting and tougher or thicker material. The shapes of portions of the connector are relatively complex.

Another vertical access connector is disclosed in U.S. Pat. No. 5,498,178 which includes a generally cylindrical electrode post holder having two clamping pieces extending laterally from the holder. One clamping piece includes a slanting plate extending from the bottom of that piece upwardly at an angle through a horizontal opening in the other clamping piece. A vertical bolt is mounted to a support piece and the bottom of the bolt engages the slanted plate.

As a lateral torque is applied to the bolt, the bolt moves downwardly and forces the slanted plate and integral clamping piece to move laterally, thus moving the clamping pieces toward one another and tightening the post holder about the post. This connector thus also relies on the clamping members themselves to perform a camming action. It too may require a taller post holder and tougher or thicker material in order to achieve sufficient gripping force. The shapes of the portions of connector, while different than those described above, are also relatively complex.

Yet another vertical access connector is disclosed in U.S. Pat. No. 5,088,941 which includes a generally cylindrical opening for fitting about a battery post which is formed by two jaws. Several embodiments are disclosed, each having a cam face on the jaws and a vertical screw passing through a portion of each jaw. The jaws are initially spaced from one another to create a gap which closes upon application of torque to the screw. Here too, the jaws themselves are camming members, with attendant strength, packaging and manufacturing limitations. Additionally, the connector is made by a die cast process, which is relatively expensive and of increased weight.

It is therefore desirable to provide a battery terminal connector of the vertical access type which is sturdy, inexpensive, simple to manufacture, easy to install, and which provides sufficient gripping force about a battery post in a compact package. It is particularly desirable to provide such connectors of parts that can be fabricated with relatively simple tooling.

SUMMARY OF THE INVENTION

This invention provides a battery terminal connector of the vertical access type which is robust, easy to fabricate, and uncomplicated in design. It provides sufficient force for gripping about a battery post upon application of a torque which is laterally applied or which has a significant lateral component. The connector can be packaged for use in limited space and height configurations, and it does not require complex tooling for installation or manufacture.

In a preferred embodiment the connector includes a connector plate having a top surface, a bottom surface, two ends and a generally cylindrical, such as conical post fitting extending upwardly from the top surface intermediate the ends. The fitting defines an opening for receiving the battery post. A slot extends from one end of the plate to the cylindrical fitting, dividing one end of the plate into two spines. The plate is preferably fabricated as a stamped sheet metal structure including drawing and extrusion processes. An extender, such as a bolt, extends upwardly from one of the spines. The head of the bolt is in contact with the bottom surface of the plate and is restrained from rotation. The restraint is achieved, for example, by having the bolt head serrated and driven into the bottom surface, or by forming in the plate a downwardly extending rib against which the head of the bolt seats. The other spine is formed with a camming band receiver, such as a clasp portion rising upwardly from the spine or an opening in the spine. In a preferred embodiment a camming band, preferably having two apertures, is seated atop the connector plate with one of the apertures positioned about the clasp portion of one spine and the other aperture positioned about the shaft of the bolt on the other spine. The band thus extends across the slot. One of the band apertures is configured to engage and seat closely about the clasp, and the other is oblong with its major axis generally normal to the slot. The oblong aperture forms a camming surface on the band. In another embodiment the camming band receiver, instead of a clasp, is a cleft formed in the spine that cooperates with a mating grip portion of the camming band.

A nut is threaded onto the shaft of the bolt. The nut has a truncated camming surface. The camming surface of the nut is sized and configured such that as a torque having a lateral component is applied from above, the nut moves downwardly and the nut camming surface interacts with the band camming surface to move the band laterally. Lateral movement of the band pulls the clasp or cleft such that the spines are forced toward one another, tending to close the slot and tighten the fitting about the battery post. The portion of the connector opposite the spines can be configured in a variety of ways to receive one or more electrical conduits.

A vertical access connector in accordance with the invention can readily be installed on the vertical post of a battery through access between, for example, forty-five and ninety degrees from horizontal, to receive a torque with a sufficient horizontal component.

BRIEF DESCRIPTION OF THE DRAWINGS

The advantages, nature and additional features of the invention will become more apparent from the following description, taken in connection with the accompanying drawings, in which.

DESCRIPTION OF THE PREFERRED EMBODIMENTS

Figure 23:
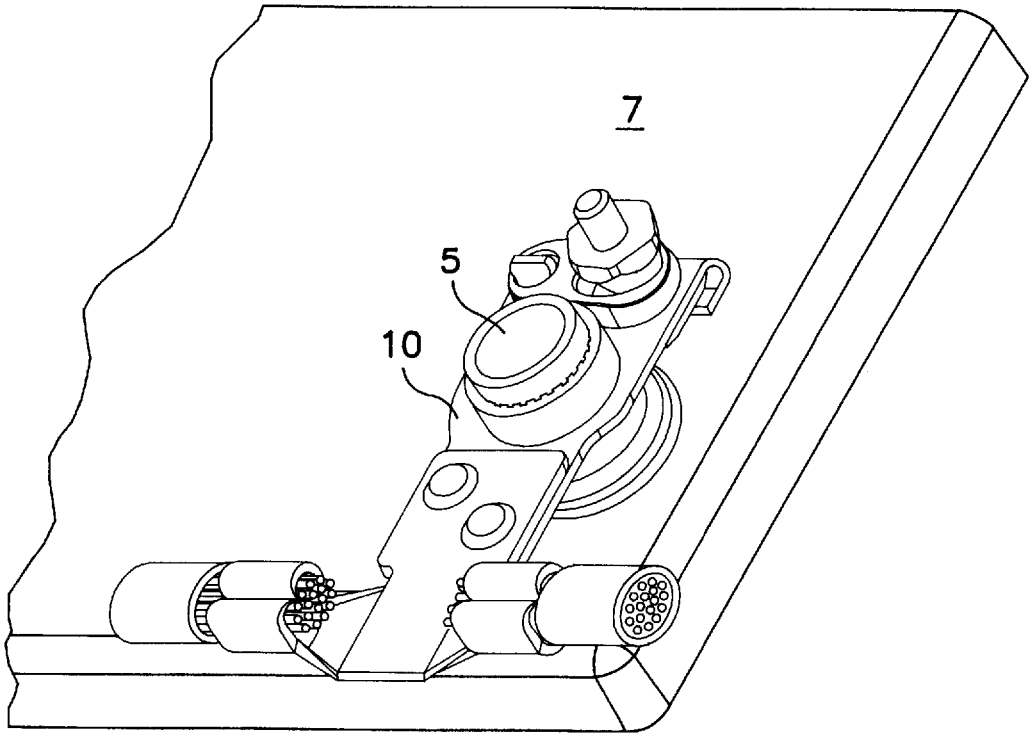
FIG. 23 is a perspective view of a terminal connector in accordance with the invention mounted on a battery post.

As used herein, terms such as "upwardly," "downwardly," "horizontal," "vertical," "top," "bottom," "laterally" and the like are with reference to a connector mounted on a battery 3 having a battery post 5 extending upwardly from a top surface 7 of the battery 3, as depicted in FIG. 23.

Figure 1:
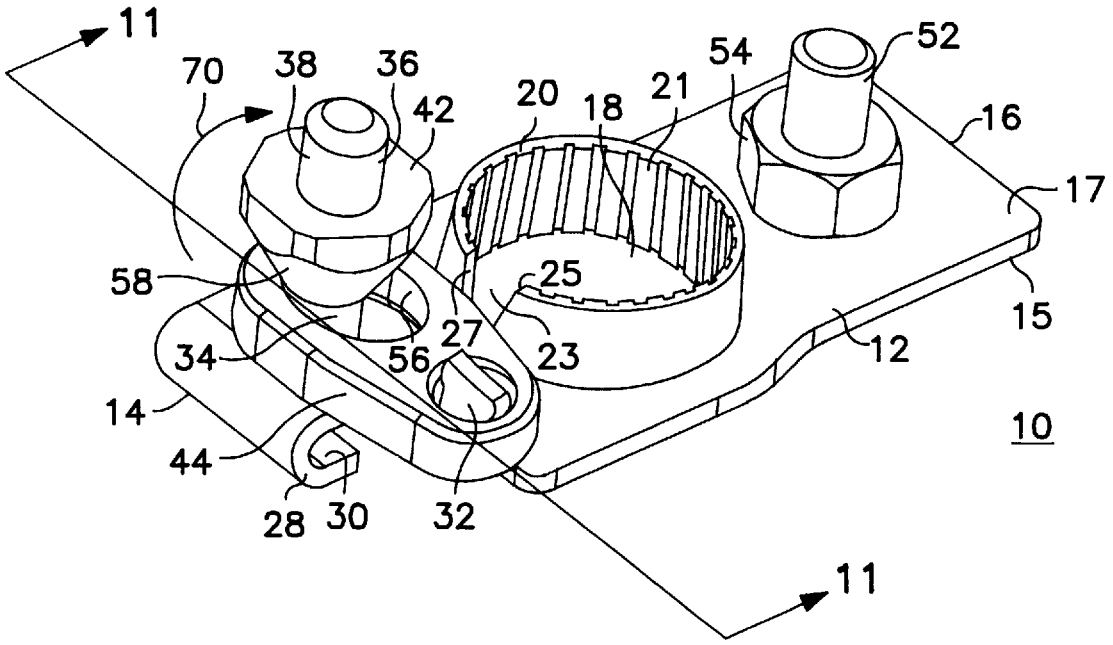
FIG. 1 is a perspective view of a battery terminal connector in accordance with the invention.
Figure 2:
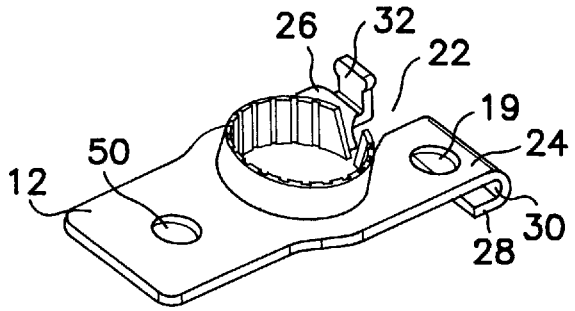
FIG. 2 is a perspective view of a connector plate of the connector of FIG. 1.
Figure 3:
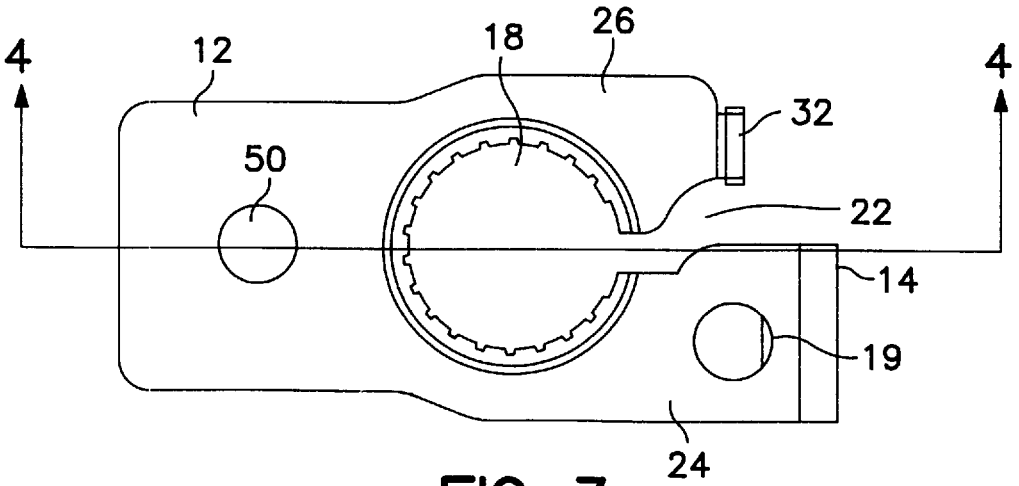
FIG. 3 is a top view of the connector plate of the connector of FIG. 1.
Figure 4:
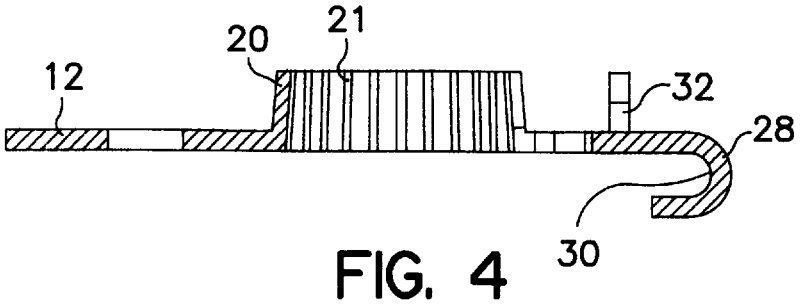
FIG. 4 is a section view taken at 4—4 of FIG. 3.

Referring now to FIG. 1 there is shown a battery terminal connector 10 in accordance with a preferred embodiment of the invention. The connector 10 comprises a connector plate 12 extending from a first end 14 to a second end 16. The plate has a bottom surface 15 and a top surface 17. Intermediate the ends 14, 16 is a post aperture 18 formed by a generally cylindrical upwardly extending post fitting 20 having an upwardly extending central axis. The post fitting 20 can be of other configurations, is sized and contoured to contact about the battery post 5, and can include a serrated inner surface 21. The serrated surface provides an anti-rotation feature between the fitting 20 and post 5. An anti-creep feature can also be utilized, such as incorporation of a circumferential edge on the fitting 20 that grips the post 5. As shown best in FIGS. 2 through 4, plate 12 includes an extender opening 19 and a slot 22 extending from first end 14 to post aperture 18. The slot forms in the plate 12 a first spine 24 and a second spine 26. The slot 22 is of variable width, that is, the spines 24, 26 can be forced toward one another to vary the width of the slot 22.

Figure 5:
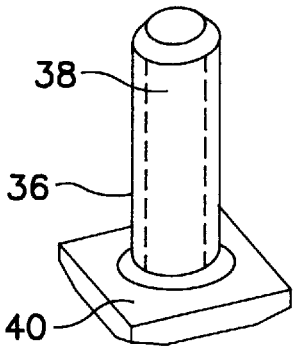
FIG. 5 is a perspective view of a bolt of the connector of FIG. 1.
Figure 6:
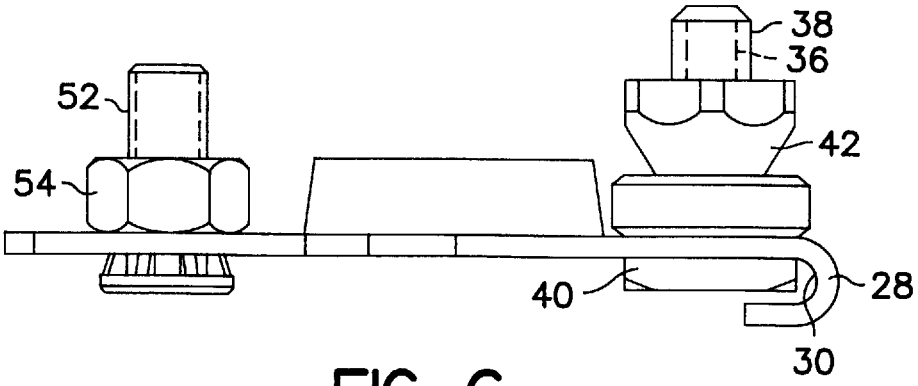
FIG. 6 is a side elevation view of the connector of FIG. 1.
Figure 7:
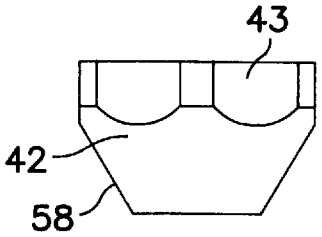
FIG. 7 is a side view of a nut of the connector of FIG. 1.
Figure 8:
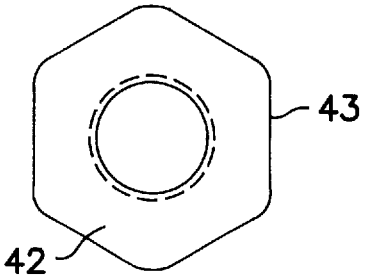
FIG. 8 is a top view of the nut of FIG. 6.

The plate 12 can include a rib 28 extending downwardly therefrom and having a restraining surface 30. Extending upwardly from the second spine 26 is a camming band receiver or clasp 32. Extending upwardly from the first spine is an extender 34, such as a bolt 36 having an upwardly extending axis parallel to the axis of the post fitting 20. Preferably the post fitting 20, clasp 32 and rib 28 are formed as an integral structure with the plate 12. The bolt 36, as shown best in FIGS. 5 and 6, has a threaded shaft 38 and a square head 40, which head is restrained from motion through contact with the restraining surface 30 of the rib 28. The extender 34 can also include a nut 42 having internal threads, shown particularly in FIGS. 7 and 8, which engages threaded shaft 38. The nut 42 has edges 43 that can be gripped by a wrench, socket, or manually with fingers. The nut 42 preferably is designed with a prevailing torque feature as known in the art which resists backup under the influence of external forces such as vibration transmitted between the connector 10 and post 5. Rotation of the nut 42 allows it to translate upwardly and downwardly along the shaft 38.

Figure 9:
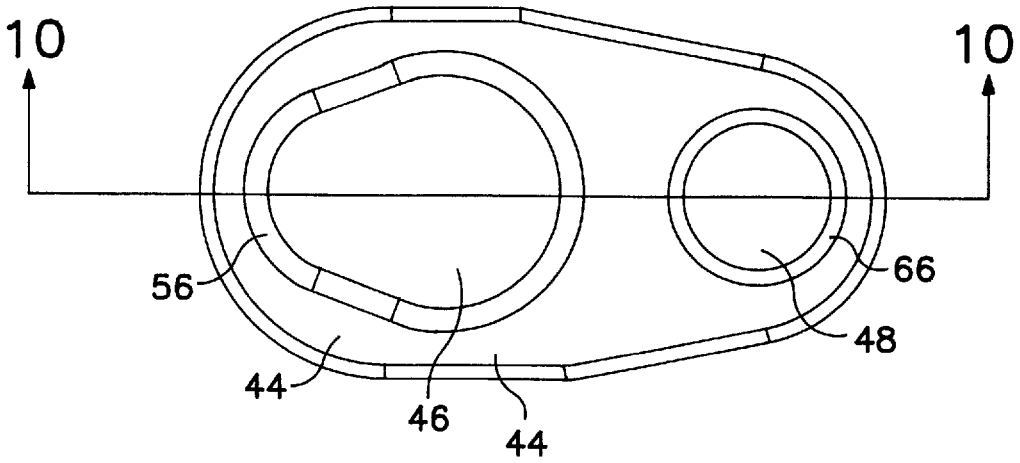
FIG. 9 is a top view of a camming band of the connector of FIG. 1.
Figure 10:
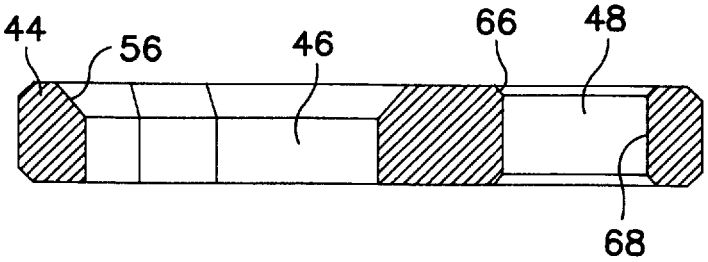
FIG. 10 is a section view taken at 10—10 of FIG. 9.

Positioned about the shaft 38 and the clasp 32 is a camming band 44. As shown particularly in FIGS. 9 and 10, the camming band 44 preferably includes an oblong cavity 46 and a gripping portion such as gripping port 48, respectively cooperating with the bolt 36 and nut 42, and with the clasp 32. The connector plate 12 also includes a junction hole 50, a threaded clinch stud 52 and a prevailing nut 54, or other means for attaching electrical connections.

Figure 11:
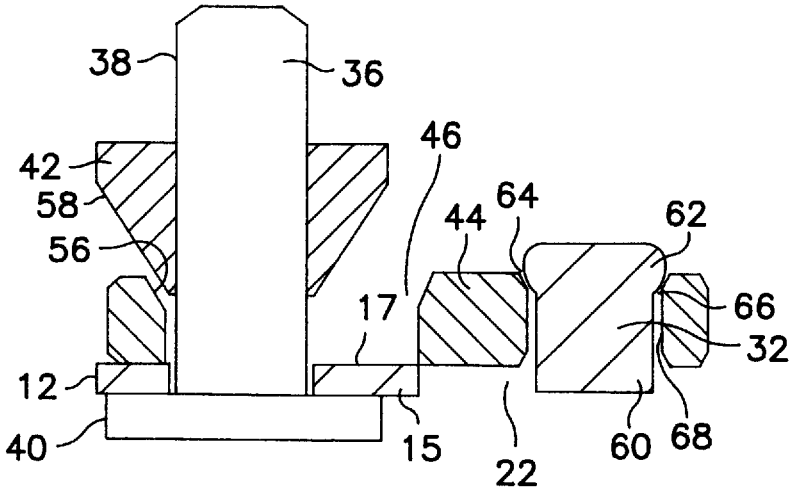
FIG. 11 is a partial section view taken at 11—11 of FIG. 1.

Referring now particularly to FIG. 11, which shows a cross section through the connector plate 12 and clasp 32, bolt 36, nut 42, camming band 44 and slot 22, it can be seen that camming band 44 contacts and interacts directly with the nut 42 and clasp 32. The oblong cavity 46 of the camming band 44 has a band camming surface 56 which is angled. Similarly, the nut 42 has an extender camming surface 58 which is also angled to form a camming pair with the band camming surface 56. Preferably each surface 56, 58 is angled at approximately thirty one degrees from vertical. The clasp 32 has a primary lower segment 60, an upper supporting segment 62, and an intermediate locking edge 64. The gripping port 48 of the camming band 44 has a chamfered edge 66 and a band support surface 68. The band support surface 68, clasp lower segment 60, chamfered edge 66 and clasp locking edge 64 contact and interact to seat the camming band 44 about the clasp 32. The chamfer is preferably at forty-five degrees. The bolt 36 is placed with the shaft 38 extending upwardly through the plate 12 and oblong cavity 46, and with the bolt 36 being restrained by rib 28. The camming band 44 is placed and oriented such that the bolt 36 extends through the oblong cavity 44. The camming band 44 is positioned about the clasp 32 during installation by press fitting the camming band 44 onto the clasp 32. This allows the gripping port 48 to pass over the clasp 32 and seat the clasp 32 in a secured position within the port 48.

When a clockwise torque 70 (FIG. 1) is applied to the nut 42, the nut 42 moves downwardly and its camming surface 58 cooperates with the band camming surface 56, the camming edge of the oblong cavity 46, to laterally move the camming band to the left in FIG. 11. This can be described as an initial stage of translation motion resulting from the rotation of the nut 42. As the camming band 44 moves to the left it pulls the clasp 32 to the left and the bolt 36 to the right (it pulls the clasp and the bolt toward one another), which closes the distance between the spines 24, 26 and lessens the width of the slot 22. This can be described as a secondary stage of translation motion. As the slot width varies and tends to close, the post fitting 20 tightens about the battery post 5. Tightening continues preferably until a preselected torque is achieved. As the spines 24, 26 move toward one another, the lateral distance between the axis of the post 5 and post fitting 20, and the axis of the extender 34 is lessened. The components are sized and configured such that the preselected torque and gripping force of the post fitting 20 about the battery post 5 are achieved before the spines 24, 26 contact one another and the slot 22 is completely closed.

The camming action thus involves the interaction of several elements which are separate structures from the plate 12. During actuation the spines 24, 26 can travel a combined distance of four millimeters or more. Over time, with repeated application and wear, the battery post 5 diameter will become smaller, and four millimeters of travel can compensate for this reduction while maintaining a desired normal force at the contact interface between the post fitting 20 and the post 5. Allowing the camming action to take place through separate elements provides flexibility in manufacture and material selection of the plate 12.

The post fitting 20 is typically circular in cross section, and configured to be compatible with a tight engaging fit about the battery post 5. Battery posts 5 typically are truncated, being wider at the bottom and smaller at the top. Similarly, the fitting 20 can be substantially a truncated cylinder. The fitting includes a slit 23 (FIG. 1) which is an upwardly rising extension of the slot 22. Thus, the fitting 20 is substantially circular in cross section, but includes a first edge 25 and a second edge 27 that bound the upwardly extending slit 23. The slit 23 is preferably a segment of the cylindrical fitting 20 comprising from zero to about twenty degrees of a circle.

It will now be evident that the disclosed connector 10 can be easily placed onto a battery post 5 from above, and tightened into a firm connection through application of a lateral torque or an angular torque having a lateral component. The torque can be applied manually, particularly with use of a wing nut (FIG. 24) or, for example, robotically, particularly with use of a more conventional cross section, such as a that of a hex nut. The only tooling needed is a simple wrench or ratchet. A torque measuring tool can also be used.

Figure 12:
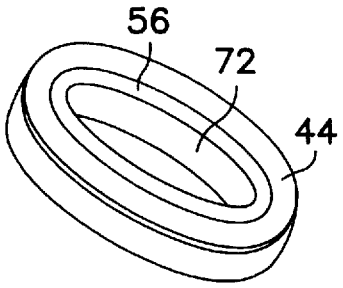
FIG. 12 is a perspective view of an alternative camming band.

Each of the components comprising the connector 12 are simple, easy to manufacture and assemble, and can be varied in structure and material. An alternative camming band 44 is shown in FIG. 12. The band 44 includes a single elongated cavity 72. The band camming surface 56 extends entirely about the single cavity 72 and functions to provide the camming interaction with the extender camming surface 58 as well as to help the band 44 to seat against the clasp 32.

Figure 13:
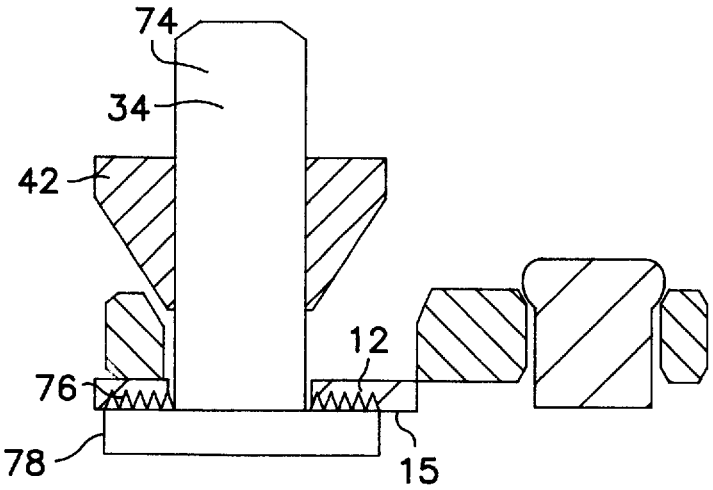
FIG. 13 is a section view, similar to FIG. 11, of another embodiment of the invention.

FIG. 13 shows an alternative embodiment where the rib 28 of the plate 12 is eliminated. Here, the extender 34 is a bolt 74 which has a roughened or serrated surface 76 on a bolt head 78 which is square, round or any convenient configuration. The serrated surface 78 fixedly engages the bottom surface 15 of the connector plate 12. Upon application of a lateral torque to the nut 42, the bolt 74 remains fixed in position. This provides a connector of less total height.

Figure 14:
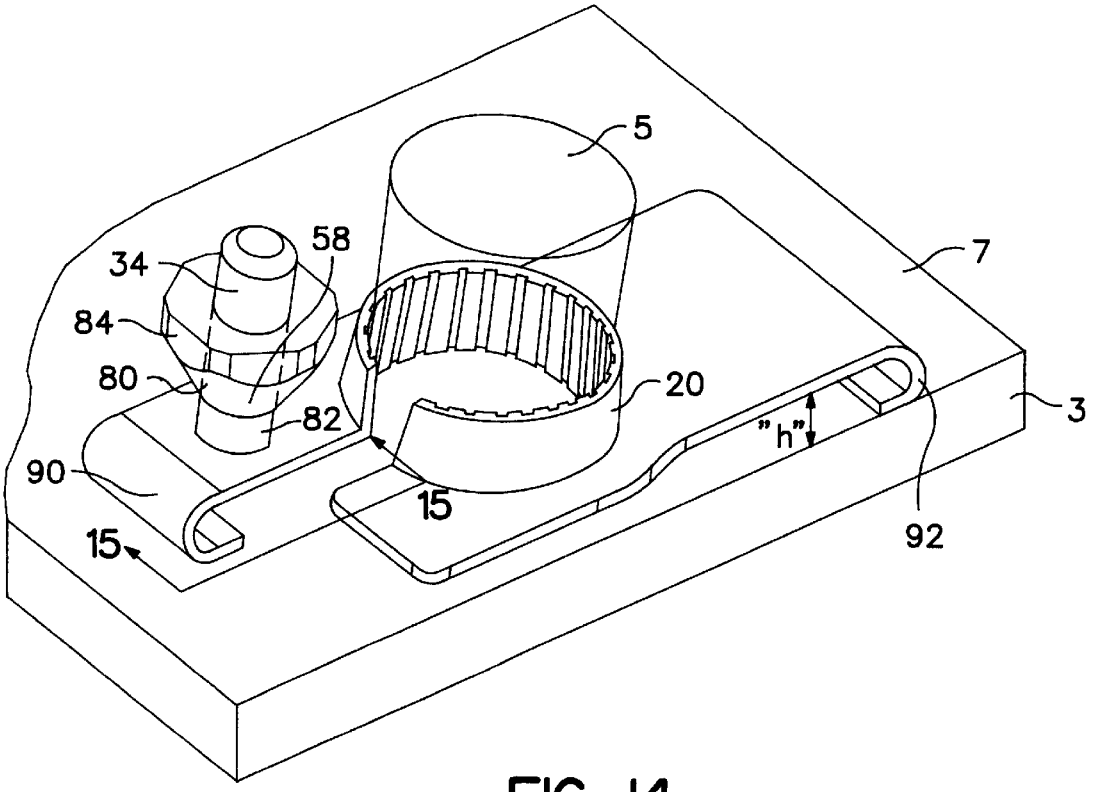
FIG. 14 is a perspective view of another embodiment of a battery terminal connector in accordance with the invention, seated on a battery.
Figure 15:
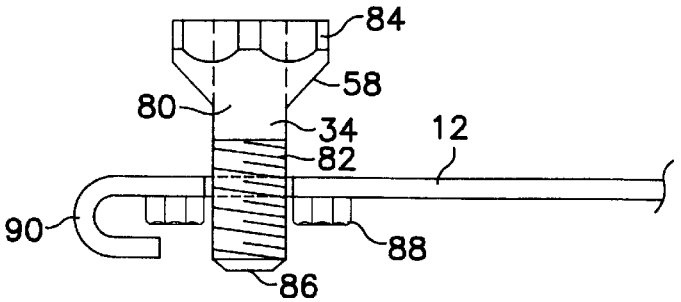
FIG. 15 is a section view taken at 15—15 of FIG. 14.

FIGS. 14 and 15 show another alternative embodiment wherein the extender 34 is a single piece upright 80 which includes a threaded shaft 82, a grasp surface 84, a bottom 86 and the extender camming surface 58. The connector plate 12 includes a clinch nut 88 and can here include a first support strut 90 and a second support strut 92 extending downwardly from the connector plate 12. The struts 90, 92 space the plate 12 a preselected distance "h" above the top surface 7 of the battery 3. The distance "h" allows the upright 80 to be rotated upon application of a lateral torque and lowered into the connector plate 12 without the bottom 86 of the upright contacting or penetrating the top surface 7 of the battery 3. The struts 90, 92 can be eliminated, for example, by sizing the post fitting 20 to seat high enough on the post 5 in those instances where the post is tapered, being broader on the bottom and smaller at the top, or by other anti-creep structures for fixedly positioning the fitting 20 onto the post 5.

Figure 16:
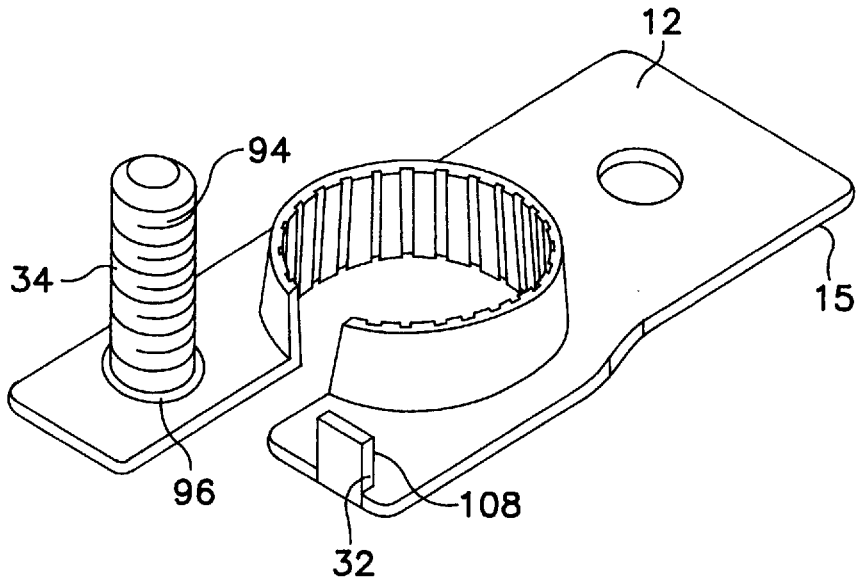
FIG. 16 is a perspective view of a connector plate in accordance with yet another embodiment of the invention.

FIG. 16 shows yet another embodiment where the extender 34 is a threaded screw 94 which is permanently affixed to the connector plate 12, such as through a welded, brazed or glued joint 96. In this configuration the total height of the connector 10 can be minimal, and the bottom surface 15 of the connector plate 12 can sit close to the top surface 7 of the battery, conserving vertical space. The extender 34 can, for example, also be a square shoulder bolt permanently affixed atop plate 12.

Yet another embodiment of the invention is shown in FIG. 17 through FIG. 20. In this embodiment a plate 112 includes a first spine 124 and a second spine 126. The second spine 126 includes a camming band receiver or cleft 101 integrally formed through the spine 126. A camming band 144 has a band camming surface 156 about a cavity 172, and a gripping portion such as peg 103. Peg 103 is sized and configured to be retained in cleft 101. Peg 103 and cleft 101 can be any of a variety of configurations, and are shown as a rectangular cleft 101 and a peg 103 of rectangular cross section extending downwardly and then horizontally when in operating position. As previously described, the band camming surface 156 reacts against an extender camming surface and the peg 103 reacts against the cleft 101 to draw the spines 124, 126 together.

Figure 24:
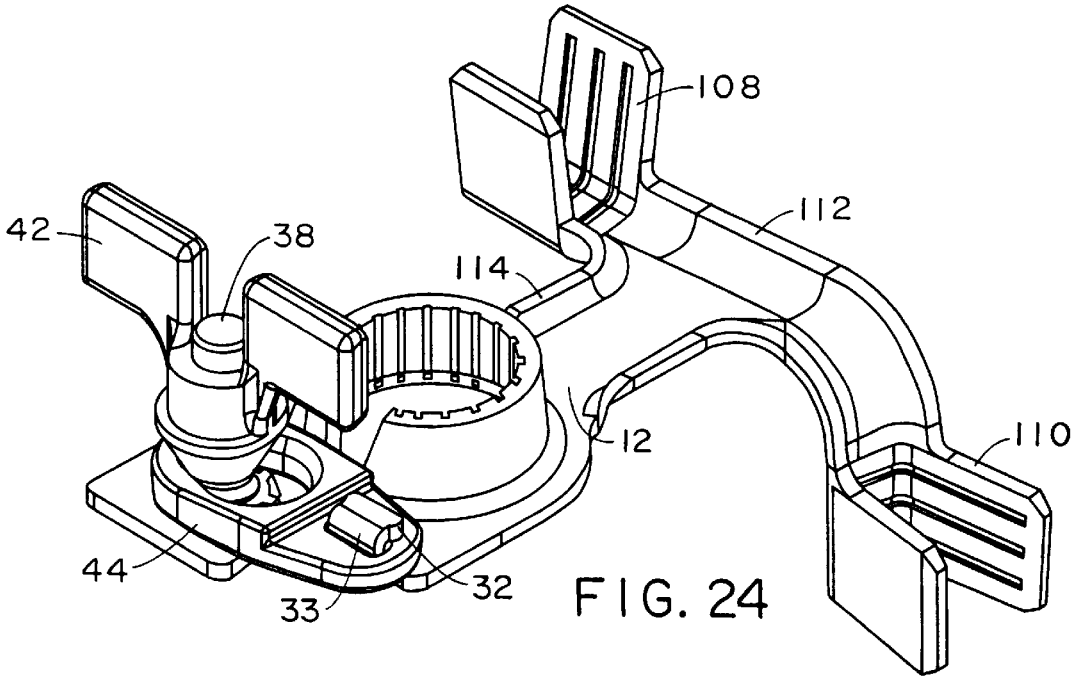
FIG. 24 is a perspective view of a preferred embodiment of a connector in accordance with the invention utilizing an alternative nut, cleft and camming band.
Figure 25:
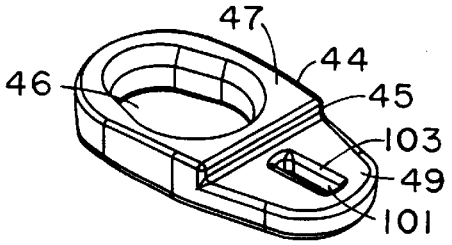
FIG. 25 is a perspective view of the camming band of the alternative embodiment of FIG. 24.

Another preferred embodiment is shown in FIG. 24. In this embodiment a wing nut 42 is utilized which provides the ability to readily rotate the nut on the shaft 38 by hand. This embodiment also shows an alternative configuration for the clasp 32 which, in this alternative, is bent, for example at edge 33, to provide a more complete interlocking between the clasp 32 and the camming band 44. An alternative camming band 44 which can be used in connection with the bent clasp 32 is shown in FIG. 25. Here the band includes a step 45 from an upper region 47 bounding the oblong cavity 46 to a lower region 49 bounding the cleft 101. The cleft 101 is provided with a chamfered surface 103. The step 45 configuration accomodates use of the bent clasp 32 without unduly elongating the clasp 32.

Figure 27:
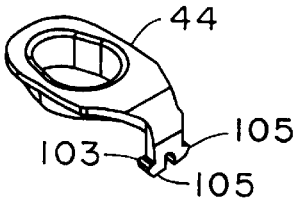
FIG. 27 is a perspective view of the camming band of the embodiment of FIG. 26.
Figure 26:
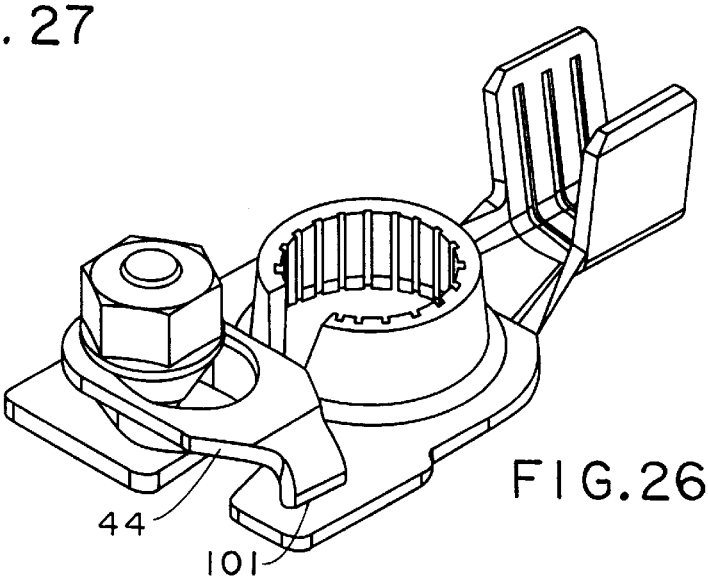
FIG. 26 is a perspective view of another embodiment of a connector in accordance with the invention.

Another alternative embodiment is shown in FIG. 26 and FIG. 27. In this embodiment the camming band 44 includes a peg 103 which has two prongs 105 which seat securely within cleft 101.

Figure 21:
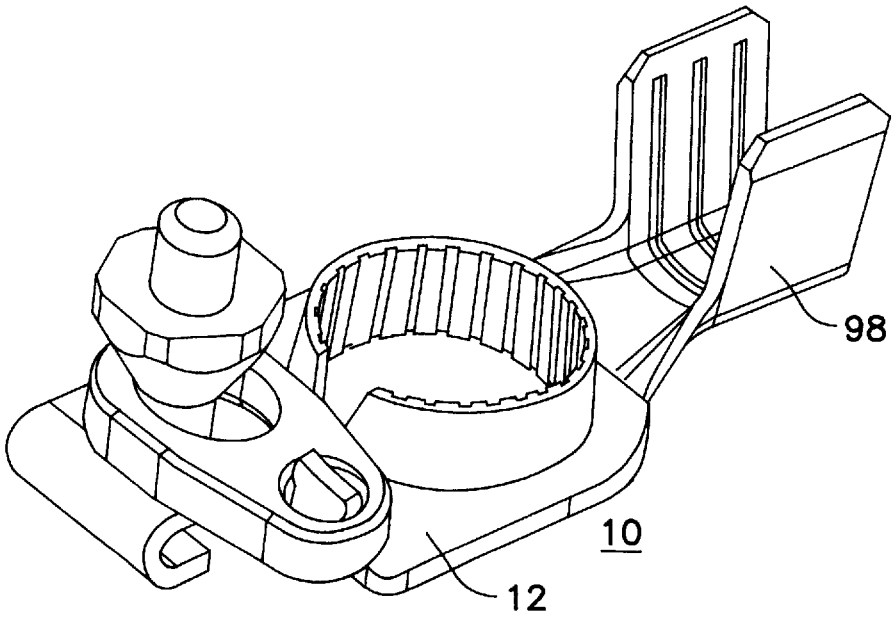
FIG. 21 is a perspective view of a connector in accordance with the invention having a single conduit receptor.
Figure 18:
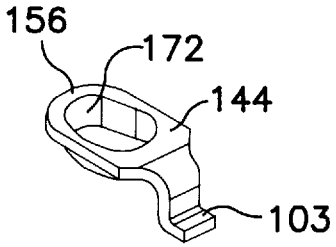
FIG. 18 is a perspective view of an alternative camming band for use with the connector plate of FIG. 17.
Figure 17:
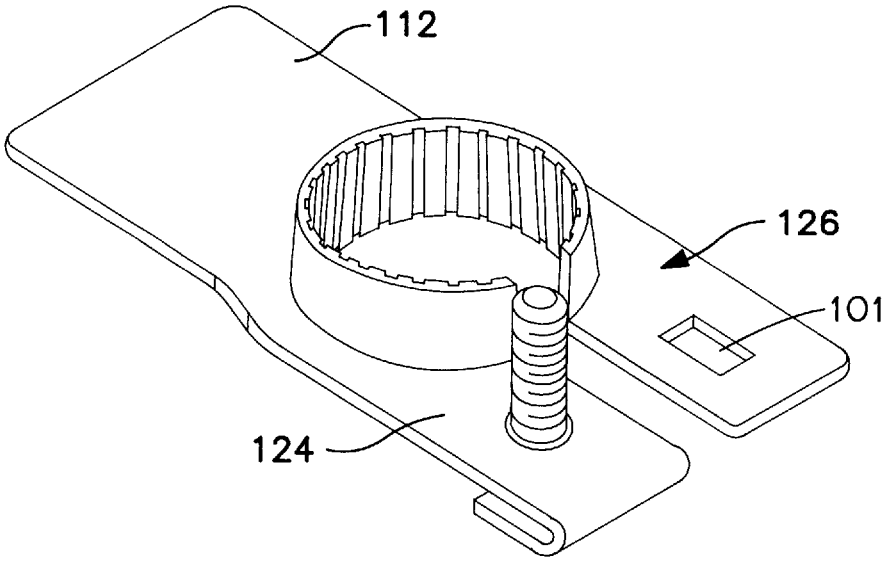
FIG. 17 is a perspective view of a connector plate in accordance with another embodiment of the invention.
Figure 19:
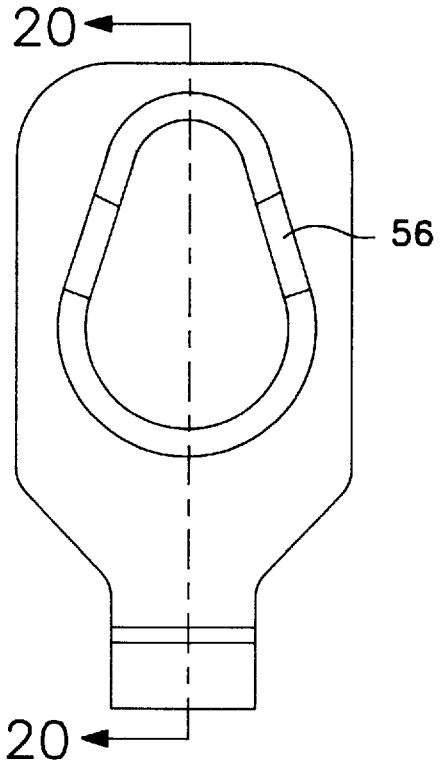
FIG. 19 is a top view of the alternative camming band of FIG. 18.
Figure 20:
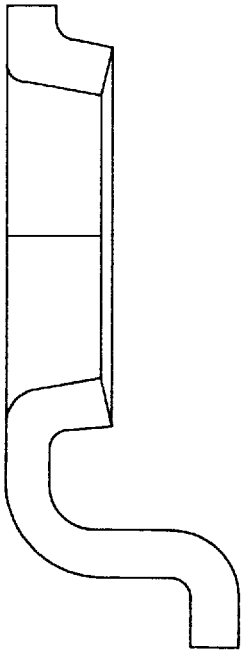
FIG. 20 is a section view taken at 20—20 of FIG. 19.
Figure 22:
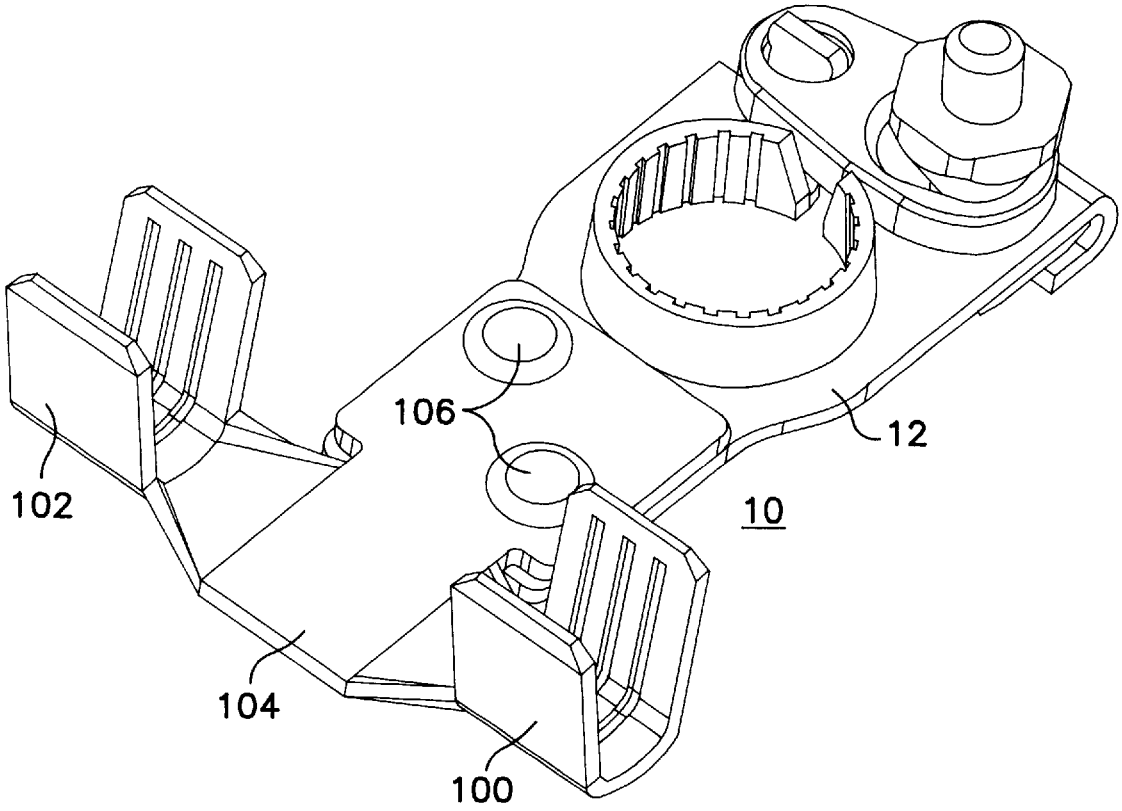
FIG. 22 is a perspective view of a connector in accordance with the invention having a dual conduit receptor.

FIGS. 21, 22 and 24 also show alternative means for connecting electrical conduits to the connector 10. FIG. 21 shows a single channel shaped conduit receptor, conductor grip 98 formed integrally with the connector plate 12. FIG. 22 shows a first conductor grip 100 and second conductor grip 102 which are mounted to the connector plate 12 in a "T" configuration through a separate mounting plate 104 and a lock joint 106. FIG. 24 shows a first conductor grip 108 and second conductor grip 110 arranged in a bent "T" configuration, including a channel 112 between the grips 108, 110 and also including a raised lip 114 on the plate 12.

It will be recognized that the battery terminal connector 10 disclosed can be easily fabricated. The nuts, bolts, and camming band can be readily fabricated as well known. The connector plate 12 can be a stamping or a stamped and formed structure. It does not require side operational stamping machines for fabrication as is necessary with most conventional stamped terminals. The preferred connector plate 12 is fabricated as a single piece stamped sheet metal structure including extrusion and drawing processes. The single piece extrusion and drawing allows the plate 12 to be made of a preselected thickness, and of a strong material. Compared to a die cast part, the plate has less material or weight, a higher electrical conductivity, and provides the ability to more easily fabricate conduit connectors of differing configurations. Fabrication can be done with the use of progressive dies, as is well known in the art. It fosters fabrication of a plate 12 and connector 10 which is compact and which provides sufficient gripping force on the battery post 5 upon application of a conventional torque. Specifically, in preferred form the post fitting is seven to ten millimeters in height, equivalent to or less than fittings of other common battery connectors. Even with this relatively low inner surface 21, sufficient anti-rotation biting force between the fitting and post is generated upon application of only eight neuton-meters of torque, based on a inner surface that is not serrated, which exceeds typical automotive commercial requirements of 4.9 neuton-meters. A serrated surface can provide sufficient anti-rotation biting at even higher torque. The serrated inner surface provides an effective electrical contact surface. The top inner edge of the serrated surface bites into the battery post and provides an anti-creep feature under applied torque.

The preferred material and construction for the component parts is:

| | |
|---|---|
| Connector Plate | 1.5 mm thickness<br>C14530 H04, C194 H02 or C260 H02 material |
| Camming Band | 5 mm thickness, 1.5 mm depth camming surface<br>E.S.A. B54 material<br>or Stamped Camming Band, 1.6 mm thickness<br>SAE 1055, RC44–46 material |
| Extender Bolt | M6 1.00 6 G Rolled Thread, 2 mm head thickness,<br>18 mm shaft height (1.5 mm from head to thread)<br>1038 SAIF Class 9.8, RC27–36 material |
| Extender Nut | 1214 with prevailing torque feature |
| Wing Nut | Acuzinc 5 with bright yellow chromate surface treatment |
| Clinch Stud | 20 mm Height M6 × 1.0 Thread<br>Manufactured by Pennsylvania Engineering Manufacturing Co. Part No. PEM HFH-Mb-15 |
| Clinch Nut | Manufactured by Pennsylvania Engineering Manufacturing Co. Part No. PEM S-Mb-2-zl |

All of the component parts are preferably treated to withstand 500 hours of salt spray coating. Optionally, certain of the components can be heat treated, such as the stamped camming band.

Although described as a connector for attachment to a vertical battery post, it is to be understood that the disclosed connector can be equally used in other orientations, such as attachment to a horizontal post or a post oriented in any direction. It will further be apparent that many alternate configurations and specifications of the battery terminal connector disclosed are possible without departing from the spirit and scope of the invention. Accordingly, within the scope of the appended claims, the invention can be practiced other than as specifically described.

I claim:

1. A battery terminal connector for connection to a battery post comprising:

a connector plate having an aperture configured to fit about said post intermediate a first end and a second end of said plate, said plate having a slot extending from said first end to said aperture so as to form in said plate a first spine and a second spine;

said first spine having an extender affixed thereto, said extender having a shaft extending upwardly from said first spine and an extender camming surface; said second spine having a camming band receiver integrally formed therewith;

a camming band having a band camming surface configured to cooperate with said extender camming surface and a gripping portion configured to cooperate with said camming band receiver; and at least a portion of said extender being rotatable such that said extender camming surface contacts said band camming surface and moves said band so that said gripping portion of said camming band and said camming band receiver move toward said extender, thereby varying the width of said slot and tightening said aperture about said post.

2. The battery terminal connector of claim 1 wherein said extender comprises a threaded bolt and nut, said nut including said extender camming surface and being rotatable on said bolt.

3. The battery terminal of claim 1 wherein said aperture has a central upwardly extending axis and said extender shaft has an upwardly extending axis, and wherein upon said varying of the width of said slot and tightening of said aperture about said post, the distance between said axes is lessened.

4. A battery terminal connector for connection to a battery post comprising:

a connector plate having a first end, a second end, an aperture intermediate said ends, said aperture contoured to contact about said post, and a slot of variable width extending from said first end to said aperture so as to form in said connector plate a first spine and a second spine;

an extender having a shaft rising from said first spine;

a clasp portion rising from said second spine;

a camming band having a band camming surface cooperating with said extender and a gripping portion cooperating with said clasp;

at least a portion of said extender being rotatable to contact said camming band and move said band such that said gripping portion and clasp move toward said extender, thereby varying the width of said slot and tightening said aperture about said post.

5. The terminal connector of claim 4 further comprising a nut rotatable and translatable on said extender shaft, said nut having an extender camming surface cooperating with said band camming surface.

6. The terminal connector of claim 4 wherein said band camming surface comprises a cavity in said band positionable about said extender.

7. The terminal connector of claim 4 wherein said extender comprises a threaded bolt and nut, said nut being rotatable on said bolt.

8. The terminal connector of claim 7 wherein said connector plate has a top side and a bottom side, and wherein said bolt has a head contacting said bottom side.

9. The terminal connector of claim 7 wherein said head of said bolt has a roughened surface fixedly secured to said bottom side.

10. The terminal connector of claim 7 wherein said connector plate has a rib extending downwardly below said bottom side, and wherein said bolt head has a surface contacting and restrained by said rib.

11. The terminal connector of claim 4 wherein said aperture is formed by a post fitting rising from said connector plate.

12. The terminal connector of claim 11 wherein said post fitting includes a roughened inner surface contacting said post.

13. The terminal connector of claim 12 wherein said roughened inner surface is vertically serrated.

14. The terminal connector of claim 11 wherein said post is circular in cross section and said post fitting is substantially circular in cross section.

15. The terminal connector of claim 14 wherein said post fitting has a central axis and said extender shaft has an axis parallel to said post fitting axis, and wherein upon said movement such that said gripping portion and clasp move toward said extender, the distance between said axes is lessened.

16. The terminal connector of claim 11 wherein said post and post fitting are truncated.

17. The terminal connector of claim 4 wherein said band camming surface comprises an oblong cavity positioned about said extender.

18. The terminal connector of claim 17 wherein said oblong cavity is generally normal to said slot.

19. The terminal connector of claim 17 wherein said band camming surface comprises an angled internal surface.

20. The terminal connector of claim 4 wherein said connector plate has a top side and a bottom side and wherein said shaft is the shaft of a bolt having a head, said head having a serrated surface contacting said bottom side and thereby being restrained from rotation.

21. The terminal connector of claim 4 wherein said shaft is rigidly affixed to said connector plate.

22. The terminal connector of claim 21 wherein said shaft is welded or brazed to said connector plate.

23. The terminal connector of claim 4 wherein said connector plate has a first support rib extending downwardly from said first spine and a second support rib extending downwardly from said second end, wherein said first spine has a threaded hole therethrough, and wherein said extender comprises a threaded shaft and an integral head having a head camming surface, said extender being rotatable to move said shaft along said threaded hole such that said head camming surface contacts said band camming surface to laterally move said band.

24. The terminal connector of claim 5 wherein said connector is configured to accept a torque applied to said nut of at least 4.9 newton-meters.

25. The terminal connector of claim 4 further comprising a coupling for connection of an electrical conduit.

26. The terminal connector of claim 4 wherein said connector plate is fabricated as stamped sheet metal piece including extrusion and drawing processes.

27. The terminal connector of claim 1 further comprising a coupling for connection of an electrical conduit.

28. A battery terminal connector for connection to a battery post comprising:

a connector plate having a first end, a second end, an aperture intermediate said ends, said aperture contoured to contact about said post, and a slot of variable width extending from said first end to said aperture so as to form in said connector plate a first spine and a second spine;

an extender having a shaft rising from said first spine;

a cleft formed in said second spine;

a camming band having a band camming surface cooperating with said extender and a gripping portion cooperating with said cleft;

at least a portion of said extender being rotatable to contact said camming band and move said band such that said gripping portion and second spine move toward said extender, thereby varying the width of said slot and tightening said aperture about said post.

29. The connector of claim 28 wherein said gripping portion comprises a peg.

30. The connector of claim 28 further comprising a coupling for connection of an electrical conduit.

31. The connector of claim 28 wherein said aperture is formed by a post fitting rising from said connector plate.

32. The connector of claim 28 wherein said aperture is generally circular having a central axis, and wherein said extender shaft has an axis parallel to said aperture axis, and wherein upon said gripping portion moving toward said extender, the distance between said axes is lessened.

33. A terminal connector for attachment to a battery post, comprising:

a generally cylindrical post fitting sized and configured to seat about said post, said fitting having an open slit therein;

a connector plate integrally formed with said post fitting, said plate having a first spine and a second spine spaced by a slot extending from said slit, said first spine having an extender extending upwardly therefrom and said second spine having a gripping portion formed integral therewith;

a camming band contacting said extender and said gripping portion and extending across said slot, said band having a band camming surface;

said extender having a movable extender camming surface configured to interact with said band camming surface such that upon movement of said extender camming surface in a preselected direction, said extender camming surface contacts and moves said camming band surface, camming band, gripping portion and second spine to lessen the width of said slot and slit and tighten said fitting about said post.

34. The connector of claim 33 wherein said plate further comprises an integrally formed conduit grip.

35. The connector of claim 33 wherein said plate further comprises a first and second conductor grip.

36. The connector of claim 35 wherein said first and second conductor grip are arranged with said plate in a bent "T" configuration.

37. The connector of claim 33 wherein said extender comprises a threaded shaft and a wing nut, and said movable extender camming surface is on said wing nut.

38. A battery comprising:

a vertically extending battery post; and a terminal connector connected to said post, said connector including:

a connector plate having an aperture configured to fit about said post intermediate a first end and a second end of said plate, said plate having a slot extending from said first end to said aperture so as to form in said plate a first spine and a second spine;

said first spine having an extender affixed thereto, said extender having a shaft extending upwardly from said first spine and an extender camming surface;

said second spine having a camming band receiver integrally formed therewith;

a camming band having a band camming surface configured to cooperate with said extender camming surface and a gripping portion configured to cooperate with said camming band receiver; and at least a portion of said extender being rotatable such that said extender camming surface contacts said band camming surface and moves said band so that said gripping portion of said camming band and said camming band receiver move toward said extender, thereby varying the width of said slot and tightening said aperture about said post.

* * * * *